US005127348A

United States Patent [19]

Scholl et al.

[11] Patent Number: 5,127,348

[45] Date of Patent: Jul. 7, 1992

[54] SEWING MACHINE WITH A MOVABLE SEWING-MATERIAL HOLDER

[75] Inventors: Hans Scholl, Oerlinghausen; Horst Bernewasser, Steinhagen, both of Fed. Rep. of Germany

[73] Assignee: Dürkopp Adler Aktiengesellschaft, Fed. Rep. of Germany

[21] Appl. No.: 614,615

[22] Filed: Nov. 16, 1990

[30] Foreign Application Priority Data

Nov. 23, 1989 [DE] Fed. Rep. of Germany ..... 3938819

[51] Int. Cl.[5] ..... D05B 21/00

[52] U.S. Cl. ..... 112/121.12; 112/121.15

[58] Field of Search ..... 112/121.12, 121.15, 112/262.3, 304, 309, 257

[56] References Cited

U.S. PATENT DOCUMENTS

| | | | |
|---|---|---|---|
| 4,406,234 | 9/1983 | Johnson et al. | 112/121.12 |
| 4,506,612 | 3/1985 | Yanagi | 112/121.12 |
| 4,510,875 | 4/1985 | Peck | 112/121.12 |
| 4,563,960 | 1/1986 | Albrecht | 112/121.15 |
| 4,582,006 | 4/1986 | Yamane | 112/121.12 |
| 4,602,578 | 7/1986 | Yokoe et al. | 112/121.12 |
| 4,813,362 | 3/1989 | Vogt et al. | 112/121.12 |
| 5,003,895 | 4/1991 | Talanker | 112/121.12 X |
| 5,005,501 | 4/1991 | Kita | 112/121.12 |

FOREIGN PATENT DOCUMENTS 1931440 6/1969 Fed. Rep. of Germany .

*Primary Examiner*—Andrew M. Falik
*Assistant Examiner*—Paul C. Lewis
*Attorney, Agent, or Firm*—Ostrolenk, Faber, Gerb & Soffen

[57] ABSTRACT

A sewing-material workpiece holder for holding and positioning the sewing part. The workpiece holder is movable in the longitudinal direction of the sewing-machine arm and also in a direction transverse thereto. The holder is connected in form-locked manner via a toothed drive to a carrier. The toothed drive includes a toothed drive member mounted on the carrier, and a rack which is mounted on the sewing-material holder, the rack being in engagement with the toothed drive member when the workpiece holder is mounted on the carrier. The drive member is driven by at least one motor. The holder is locked to the carrier by a guide block or clamp which is swingably mounted on the carrier and swingable into a lower, locking position. A predetermined positional association of the sewing-material holder with the carrier is made possible by an alignment device on the carrier.

12 Claims, 14 Drawing Sheets

SEWING MACHINE WITH A MOVABLE SEWING-MATERIAL HOLDER

BACKGROUND OF THE INVENTION

The present invention relates to a sewing machine having a movable sewing-material holder, and more particularly to a sewing-material holder which is movable relative to a sewing needle in two directions extending transverse to each other, so as to obtain a seam which follows a predetermined course.

A device of this general type is known from Federal Republic of Germany 32 46 029 Al, equivalent to U.S. Pat. No. 4,406,234, which discloses a device for positioning a sewing part relative to an upwardly and downwardly moving sewing needle. This device consists essentially of a frame which has a carrier and two racks fastened to it which extend at right angles to the carrier. The racks are in engagement with pinions which can be driven by at least one first motor via a step-down gearing, as a result of which the carrier is movable along two guide rails in the longitudinal direction of the sewing-machine arm. A slide which receives the sewing-material holder and to which another rack is fastened on the other side is mounted on a guide rod which extends transverse to the direction of movement of the carrier and is firmly attached to the latter. Said rack is in engagement with another pinion, which can be driven by a second motor. For this purpose, the rack in question is connected in form-locked manner with the corresponding pinion, this connection being disengageable only by time-consuming disassembly.

A disadvantage of the known device resides in the fact that, due to the continuous engagement of the rack with the pinion, the sewing-material holder must be brought back into its predetermined initial position at the end of a sewing operation, after the finished sewn part has been removed from the sewing-material holder, to prepare for the next sewing operation. This necessity causes considerable unproductive idle time to be expended, which idle time is further increased if the sewing machine is to be loaded in continuous alternation with sewing-material holders designed for different seam patterns.

SUMMARY OF THE INVENTION

The central object of the present invention, therefore, is to develop a sewing machine into which sewing-material holders designed for different seam patterns can be inserted in rapid alternation and with a minimum of non-productive idle time.

A further object is to develop a sewing machine in which the structure of each sewing-material holder is adapted to facilitate the movement which it carries out transverse to the longitudinal direction of the sewing-machine arm.

These and other objects are achieved by a sewing machine with a movable sewing-material holder wherein the sewing-material holder can be connected in a form-locked manner to a carrier via a toothed drive; the toothed drive including a rotating toothed drive member mounted on the carrier and a rack attached to the sewing-machine holder. Advantageously, alignment means are also provided for locating the sewing-material holder in a proper initial position with respect to the carrier.

By the present invention the result is advantageously obtained that, after completion of the sewing process, a particular sewing-material holder can be removed simply and rapidly from the carrier, by disengaging its form-locked attachment to the carrier which is movable in the longitudinal direction (Y-direction) of the sewing-machine arm, and by disconnecting its drive.

It is furthermore advantageous that the drive member that moves the sewing-material holder transverse to the longitudinal direction of the sewing-machine arm (i.e., in the X-direction) need carry out at most only a slight turning movement before the insertion of the following sewing-material holder. This feature, in combination with the alignment means provided on the carrier, makes possible an efficient change of sewing-material holders.

Finally, an additional advantage is that the length of the rack which is attached to the sewing-material holder can be adapted individually to the length, in the X direction, of the desired sewing pattern as a result of which, among other advantages, the weight of the sewing-material holder is minimized.

Federal Republic of Germany 34 06 484 C2, equivalent to U.S. Pat. No. 4,563,960, discloses a sewing machine wherein transverse movement of the sewing-material holder in the X-direction is made possible by a rack and a pinion, constituting a toothed drive, which are not brought out of engagement when the sewing-material holder is changed.

A rack which is fastened to a sewing-material holder is disclosed in Federal Republic of German OS 19 31 440. The rack is mounted on the sewing-material holder, and is in engagement with a pinion which is mounted on the frame.

Other advantageous features of a sewing machine with a movable sewing-material holder are disclosed and claimed herein.

The alignment means preferably includes a pawl, which is provided on the carrier and can be temporarily moved outward toward the sewing-material holder by an external force, and a corresponding recess provided on the sewing-material holder.

The drive member may be a pinion which can be driven in form-locked manner by a motor. Alternatively, the drive member may be an endless toothed belt which can be driven in form-locked manner by at least one motor.

To secure the form-locked connection of the sewing-material holder to the carrier, there may be provided a clamp mounted on the carrier, having at least one roller with horizontal axis of rotation. It is further advantageous to have on said clamp at least two of said rollers with horizontal axis of rotation; and/or at least one roller with vertical axis of rotation. Two additional rollers with vertical axis of rotation are advantageously provided on the carrier.

Other features and advantages of the present invention will become apparent from the following description of several preferred embodiments of the invention, with reference to the accompanying drawings.

BRIEF DESCRIPTION OF THE DRAWINGS

Several embodiments of the invention will now be explained with reference to FIGS. 1 through 19 of the drawings, in which.

DETAILED DESCRIPTION OF THE DRAWINGS

At the outset, it should be noted that the use of the terms "first embodiment," "second embodiment,"etc. is merely a convenience, and is not to be taken as limiting the scope of the claimed invention. Any specific feature disclosed herein is considered to be applicable to any of the four disclosed "embodiments,"even if a particular feature may not be shown expressly as being present in one or more of the disclosed embodiments.

The terms "upper," "lower," "front," "back," etc. are also employed merely as a convenience, and are not to be taken as limiting the scope of the claimed invention.

Figure 1:
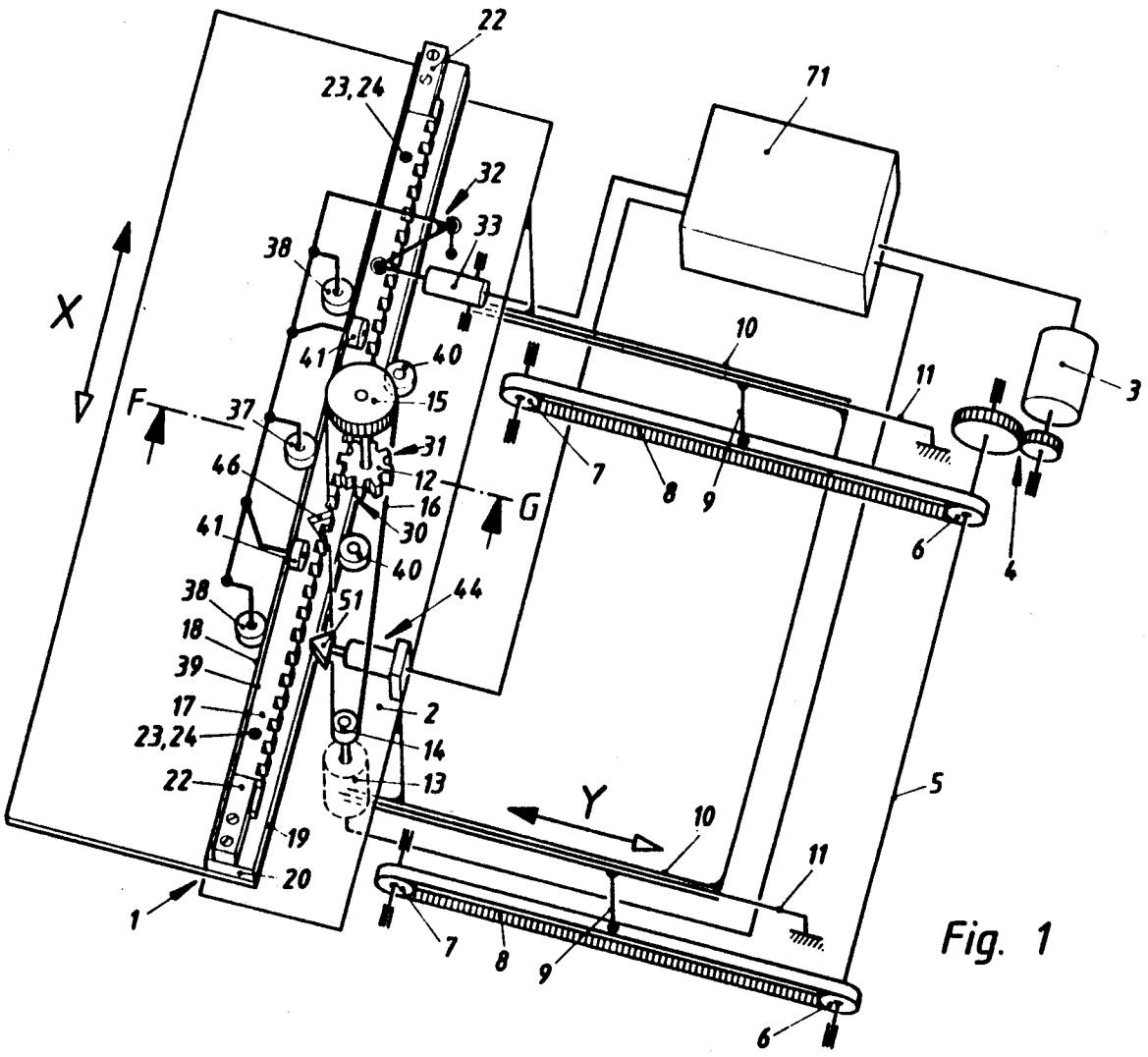
FIG. 1 is a simplified perspective view showing a sewing-material holder according to a first embodiment of the invention, which can be driven in the X-direction by a rack and pinion during the sewing process.

The various embodiments of the invention, in accordance particularly with FIGS. 1, 6, 7 and 13, all include a sewing-material holder 1 which is articulated on a carrier 2. The carrier 2 is movable in the Y-direction, and sewing-material holder 1 carries out a movement in the X-direction transverse to the direction of movement of the carrier 2. The bottom of the sewing-material holder 1 rests on a work table 2' secured to a frame (not shown in detail), in accordance with FIGS. 4, 5, 12, 16 and 18. The movement of the carrier 2 is produced, in accordance with FIG. 1, by at least one motor 3, preferably a stepping motor, a step-down gearing 4, a shaft 5 supported by the frame, two toothed-belt pulleys 6 fastened thereto, two additional toothed-belt pulleys 7, and two toothed belts 8 Each toothed belt 8 is wrapped around a respective pair of toothed-belt pulleys 6, 7. As shown in FIG. 1, each toothed belt 8 is connected by a respective driver connection 9 to one of two arms 10, each of the latter being received by a separate guide 11 fastened to the frame.

Figure 2:
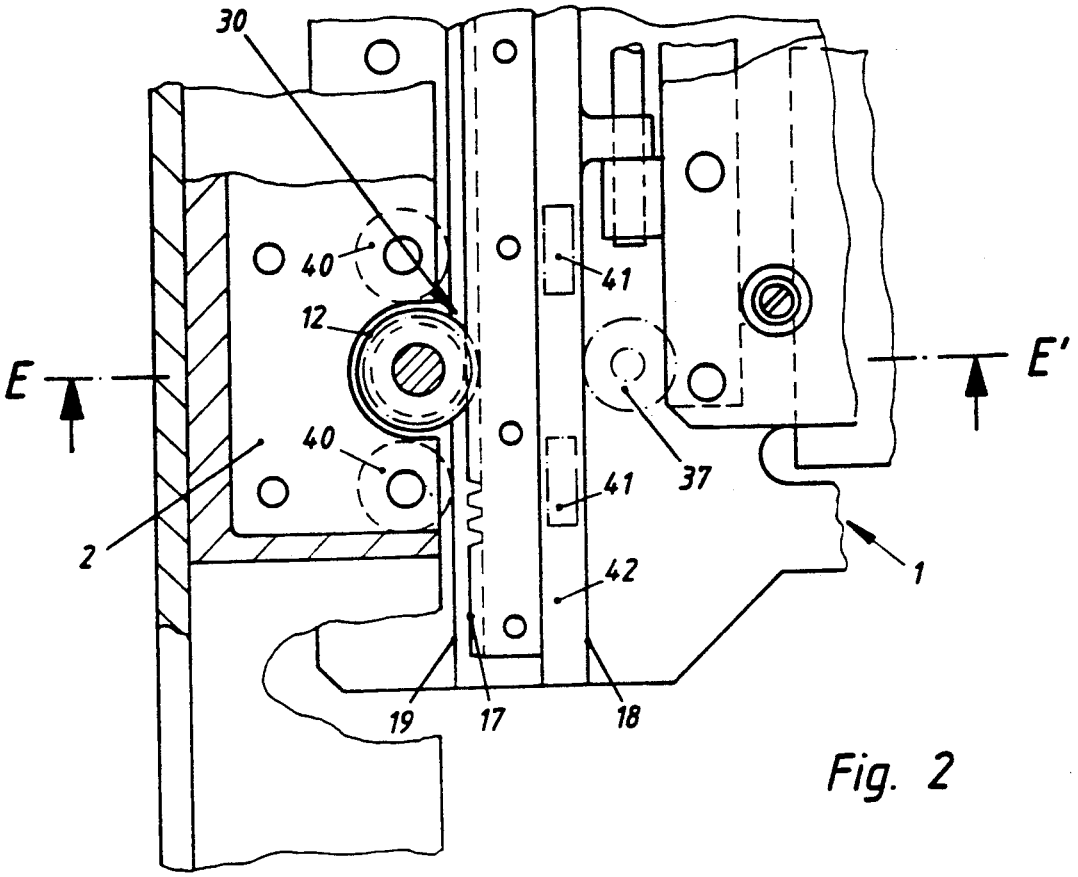
FIG. 2 is a top view of part of a modified sewing-material holder taken along the section line C-D in FIG. 3.
Figure 3:
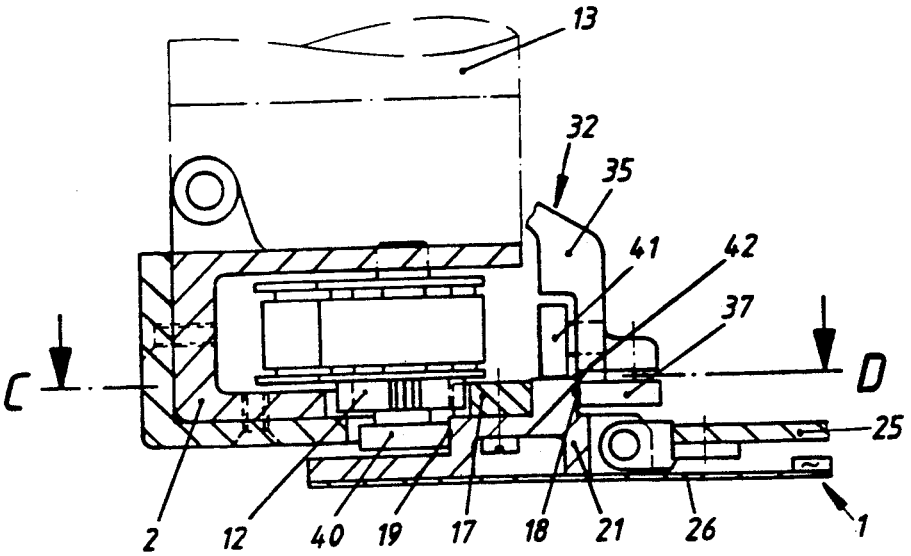
FIG. 3 is a side view of the modified sewing-material holder taken along the section line E-E' in FIG. 2, the pinion and the toothed belt pulley connected to it not being shown in section.
Figure 4:
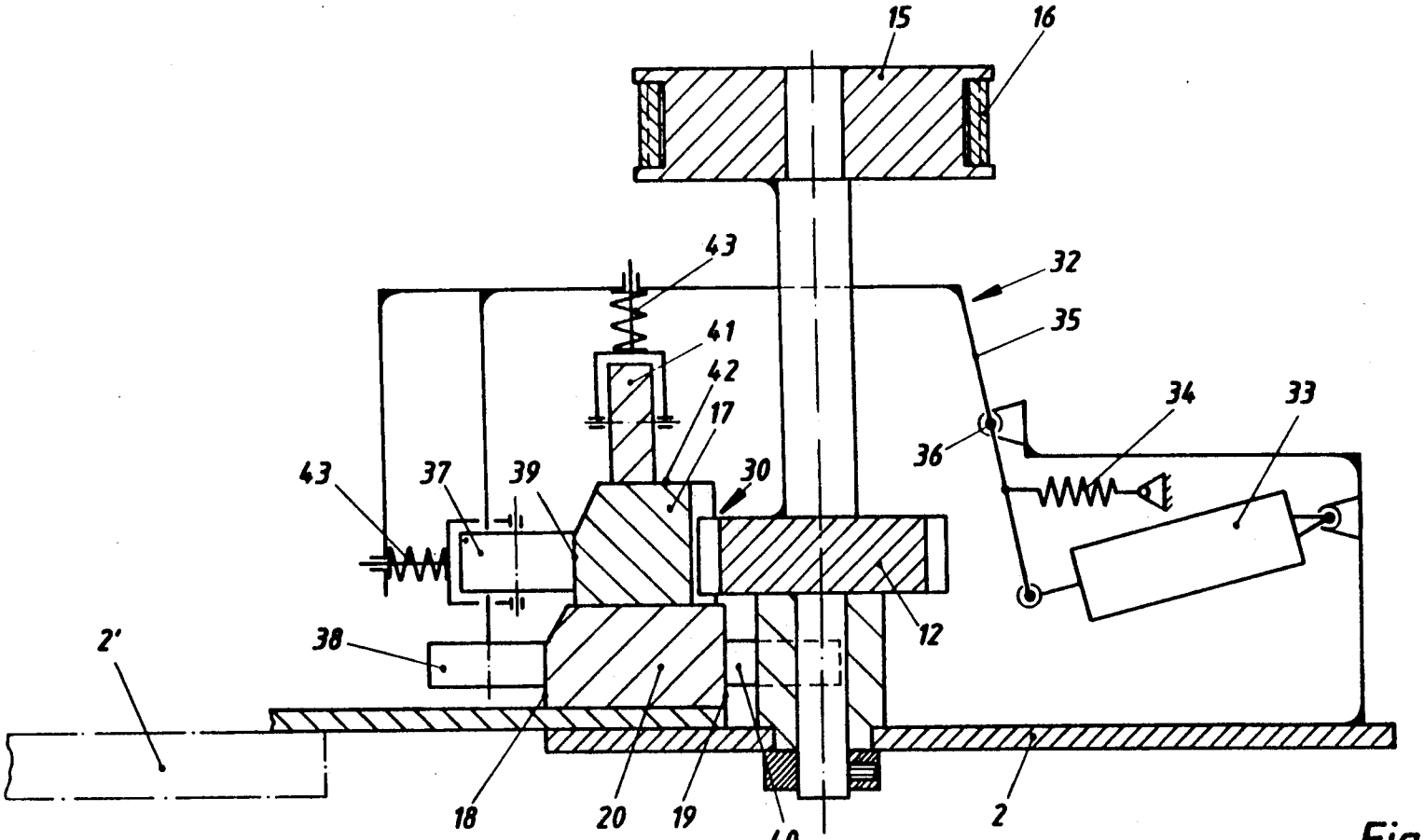
FIG. 4 is a simplified sectional view taken along the section line F-G in FIG. 1, showing diagrammatically the toothed drive and the guidance of the sewing-material holder.

In the embodiment shown in FIGS. 1 through 4, a toothed drive 30 includes a pinion 12 which is driven via a toothed-belt gearing by a motor 13, preferably a stepping motor, and the pinion 12 is turnably mounted on the carrier 2. As shown in FIGS. 1 and 3, the motor 13 is also fastened to the carrier 2. The above-mentioned toothed-belt gearing which connects the motor 13 and the pinion 12 includes a toothed-belt pulley 14, preferably having a small diameter, and another toothed-belt pulley 15 preferably of larger diameter, the latter being fixed to the pinion 12 for rotation therewith (FIG. 4). Both toothed-belt pulleys 14, 15 are wrapped around in form-locked manner by a toothed belt 16.

Figure 5:
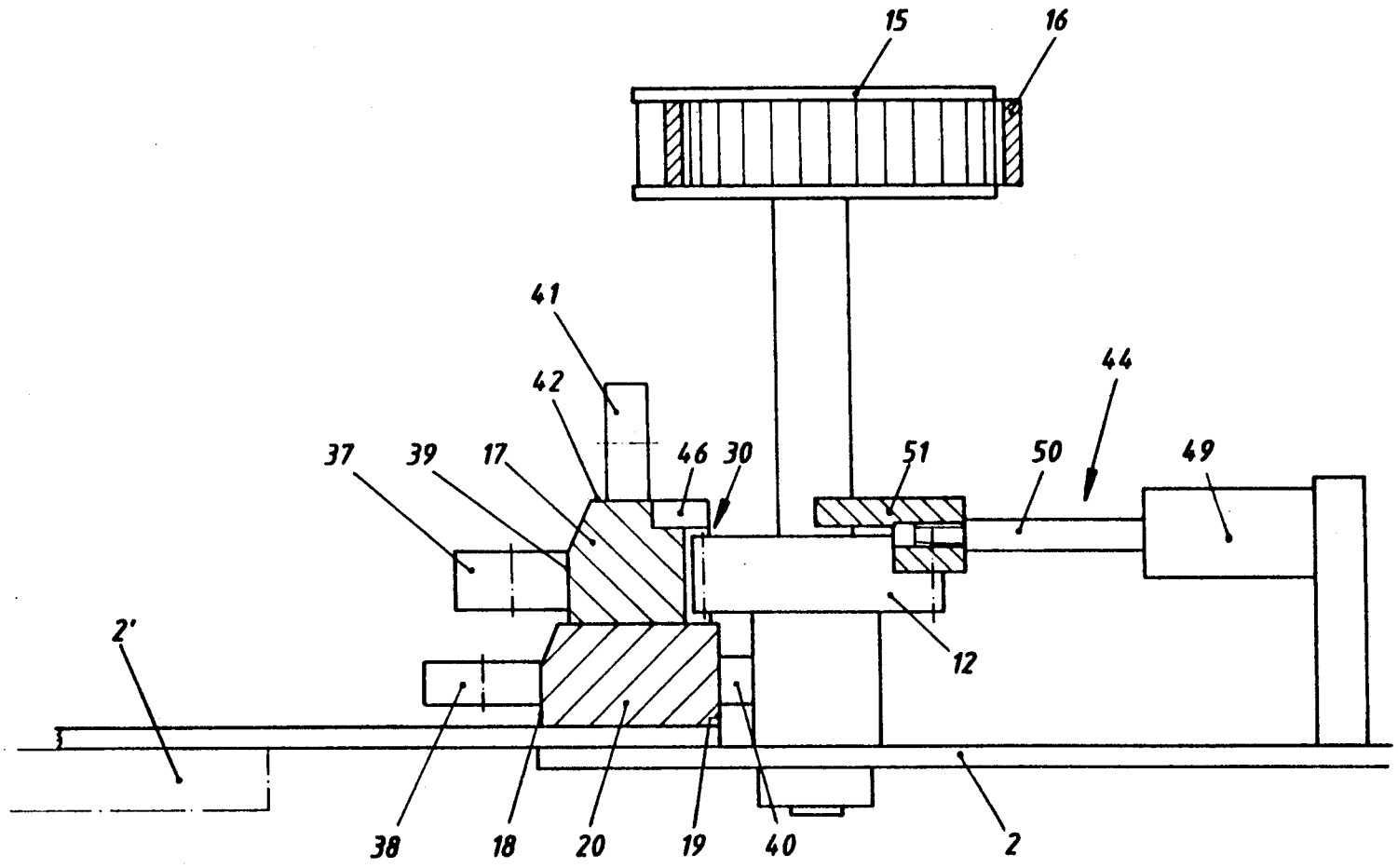
FIG. 5 is a sectional view of a second embodiment of the invention, taken along the section line H-I of FIG. 6, from which the basic construction of the alignment means can be noted.

A very important feature of this embodiment of the invention is that a rack 17 and two guide surfaces 18, 19 are provided on the sewing-material holder 1. Those two guide surfaces are provided either, as shown in FIGS. 1, 4 and 5, on a ledge 20, or as shown in FIG. 3, on a block 21 which is part of the sewing-material holder 1.

The rack 17 is in engagement with the pinion 12. In this connection, it is advisable for the rack 17 to be held immovable in the X-direction between two stop blocks 22 on the sewing-material holder, but to be movable slightly at right angles thereto. This result is achieved by two holes 23 in the rack 17 which, as shown in FIG. 1, are larger in diameter than two holding pins 24, the latter being force-fitted in the ledge 20 and being received by the holes 23. In the embodiment of the sewing-material holder shown in FIG. 3, the rack 17 is bolted to the block 21.

Figure 6:
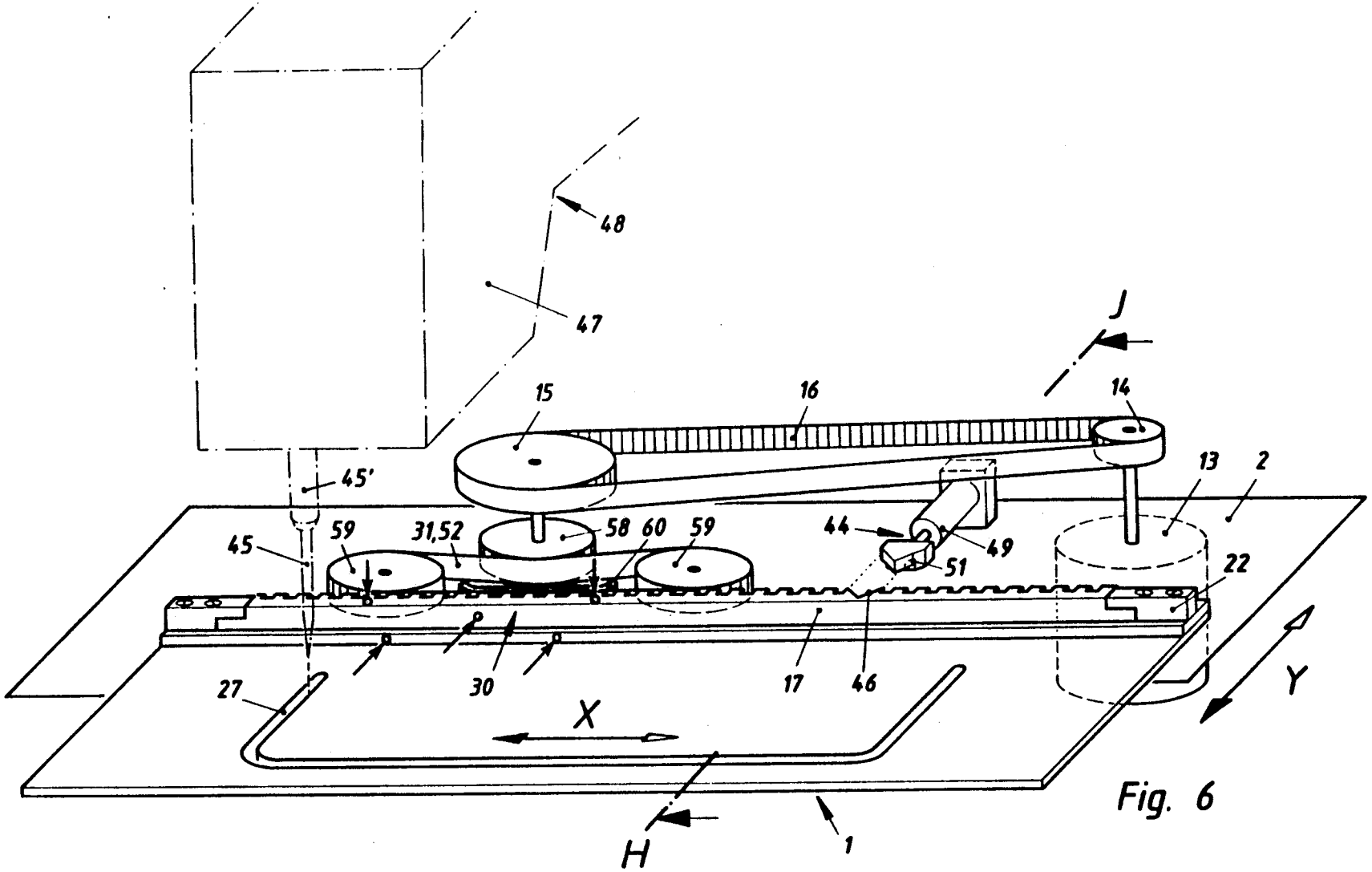
FIG. 6 is a simplified perspective view of the second embodiment, showing the sewing-material holder which can be driven in the X-direction by a toothed belt and a rack, at the beginning of a sewing process.
Figure 12:
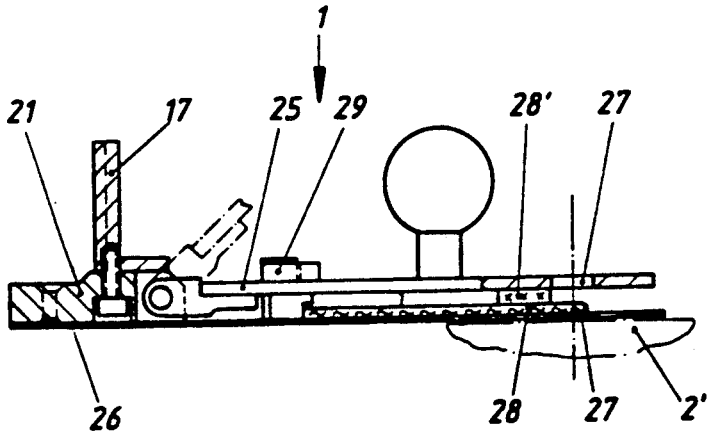
FIG. 12 is a sectional view of the sewing-material holder taken along the section line 0-P in FIG. 11.

The construction of the sewing-material holder 1, is shown in a greatly simplified manner in FIGS. 1 and 6, and can be noted particularly clearly from FIG. 12. FIGS. 2, 3, 10 and 11 also show details of the sewing-material holder 1. A clamping plate 25 is arranged swingably with respect to the block 21 which in turn is mounted immovably on a bottom plate 26. The clamping plate and bottom plate have slots 27 which correspond in shape to the sewing pattern which is desired. A sewing part 28 is received between the clamping plate 25 and the bottom plate 26, and is secured in the proper position via a strip 28' made of elastic material, for instance foam rubber, provided on the clamping plate 25. The clamping plate 25 and the bottom plate 26 are clamped together by a clamping closure 29.

Figure 16:
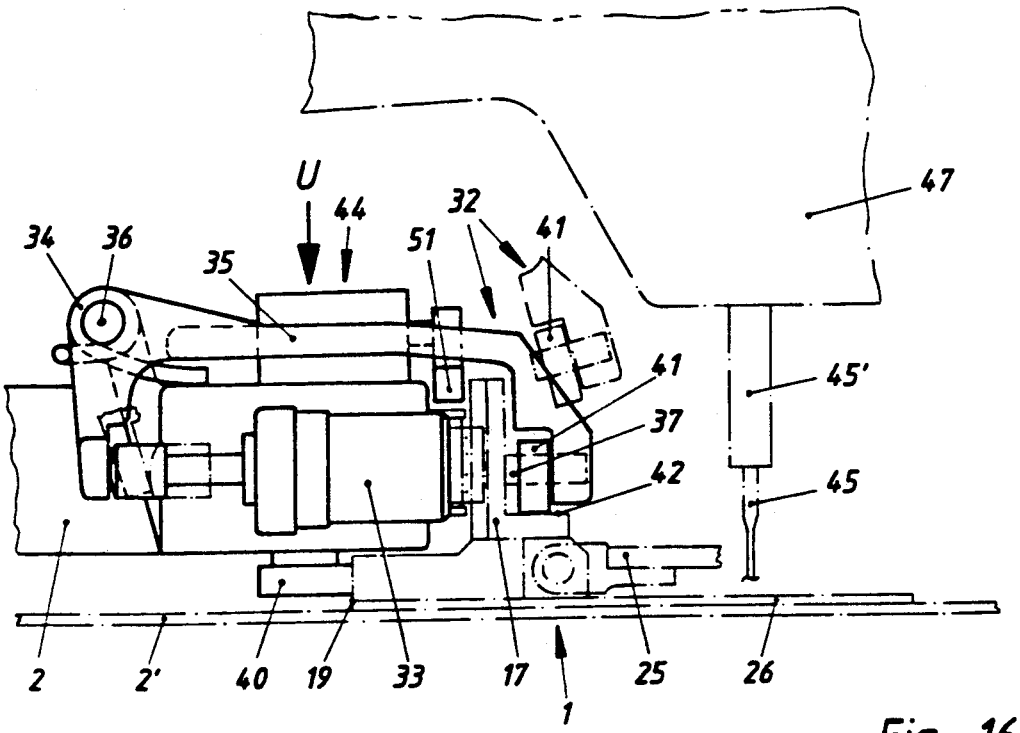
FIG. 16 is a side view of the sewing-material holder and the swingable guide block in the direction indicated by T in FIG. 13.
Figure 17:
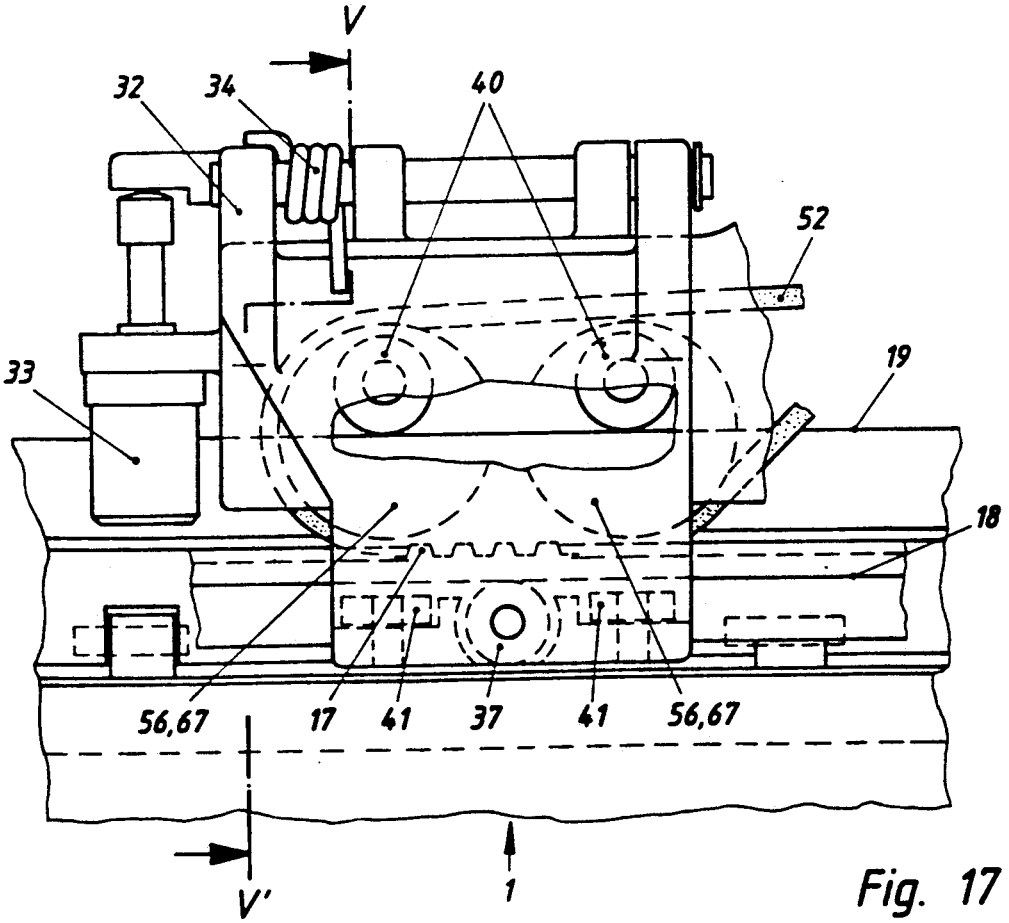
FIG. 17 is a top view of the sewing-material holder, seen in the direction U indicated in FIG. 16.
Figure 18:
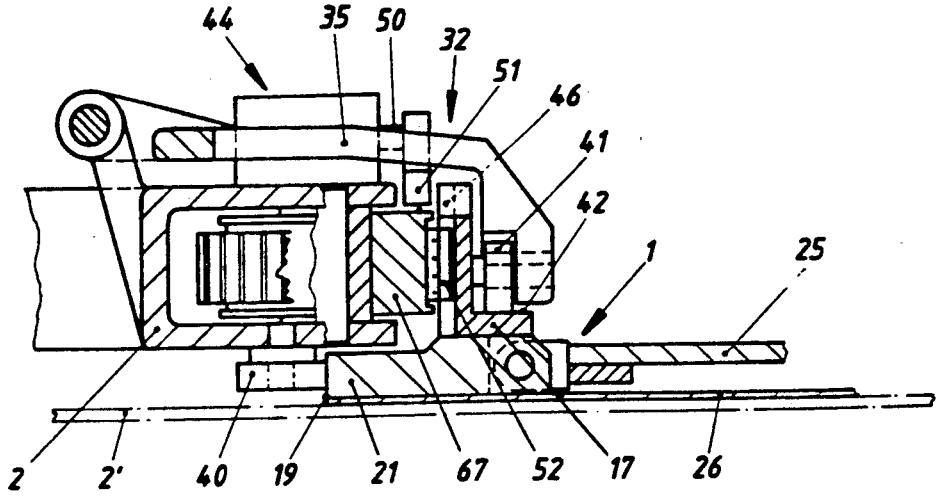
FIG. 18 is a sectional view of the sewing-material holder along the section line V—V' of FIG. 17.

In order to assure dependable operation of the toothed drive 30 during the sewing process, with dependable engagement between a drive member 31 and the rack 17, a guide block 32 is mounted on the carrier 2, as best seen in FIGS. 4, 16 and 17. The guide block 32 can be rotated into its lower, locking position (see FIG. 16), against the action of a spring 34, by action of a compressed-air cylinder 33 fastened to the carrier 2. Then, after venting the compressed air cylinder 33, the spring 34 relaxes and rotates the guide block 32 into its upper position (shown in phantom in FIG. 16) The guide block 32, as shown diagrammatically in FIGS. 1 and 4, has a double-armed lever 35 which is swingable around a pivot point 36. As shown merely diagrammatically in FIG. 1, three rollers 37, 38 with vertical axis of rotation are provided on the guide block 32. The roller 37 rolls on a resting surface 39 of the rack 17 and assures dependable engagement of the drive member 31 with the rack 17 (FIG. 4).

In the embodiment shown in FIGS. 2, 3 and 17, only one roller 37 contacts the guide surface 18 of the block 21 and the block 21 functionally engages to two rollers 40 in order to provide form-locked guidance of the sewing-material holder 1 in the X-direction.

The two above-mentioned rollers 40 with vertical axis of rotation are mounted on the carrier 2, resting against the guide surface 19 of the corresponding sewing-material holder 1. The rollers 38 shown in FIGS. 1, 4 and 5 contact the guide surface 18, providing form-locked guidance of the sewing-material holder 1 when the guide block 32 is in the low position. The embodiment shown in FIGS. 1, 4 and 5 also has a roller 37 which bears on the resting surface 39.

Finally, the guide block 32 also has at least two additional rollers 41 with horizontal axis of rotation which roll on a travel surface 42 provided on the rack 17 or the block 21 and thus permit dependable guidance of the sewing-material holder 1 moving in X-direction. It is also advisable for each of the rollers 37 and 41 to be acted on by the force of a spring 43, shown in FIG. 4 In order to minimize the frictional resistance occurring upon the movement of the sewing-material holder 1, ordinary commercial anti-friction bearings may suitably be used as the rollers 37, 38, 40 and 41.

In FIG. 6 the direction of application of the rollers 37, 38 and 41 has been shown only symbolically by arrows.

In a further embodiment of the invention (not shown), the guide block 32 is not swingably mounted on the carrier 2. In this case, it is only possible to remove a sewing-material holder 1 after completion of the sewing process by removing the rack 17 of the sewing-material holder 1 from the guidance region of the guide block 32.

In order to assure a well-defined positional association of the sewing-material holder 1 and the carrier 2, when attaching the sewing-material holder 1 which is loaded with a still unsewn sewing part 38, an alignment means 44 is provided on the carrier 2. That positional association is expressed by a well-defined distance between a sewing needle 45 and a recess 46 provided in the sewing-material holder 1, the sewing needle 45 being received by a needle bar 45' which is mounted in an arm head 47 of a sewing machine 48 (FIG. 16). As best seen in FIGS. 5 and 6, the alignment means 44 comprises a compressed-air cylinder 49 on the carrier 2, the piston rod 50 of which has a pawl 51 fastened rigidly on its free end. In the embodiments shown in FIGS. 1, 5, 6, 7, 9, 10, 13, 14, 16, 18 and 19, the alignment means 44 represented by the pawl 51 cooperates with the recess 46 which is provided in the rack 17.

Figure 10:
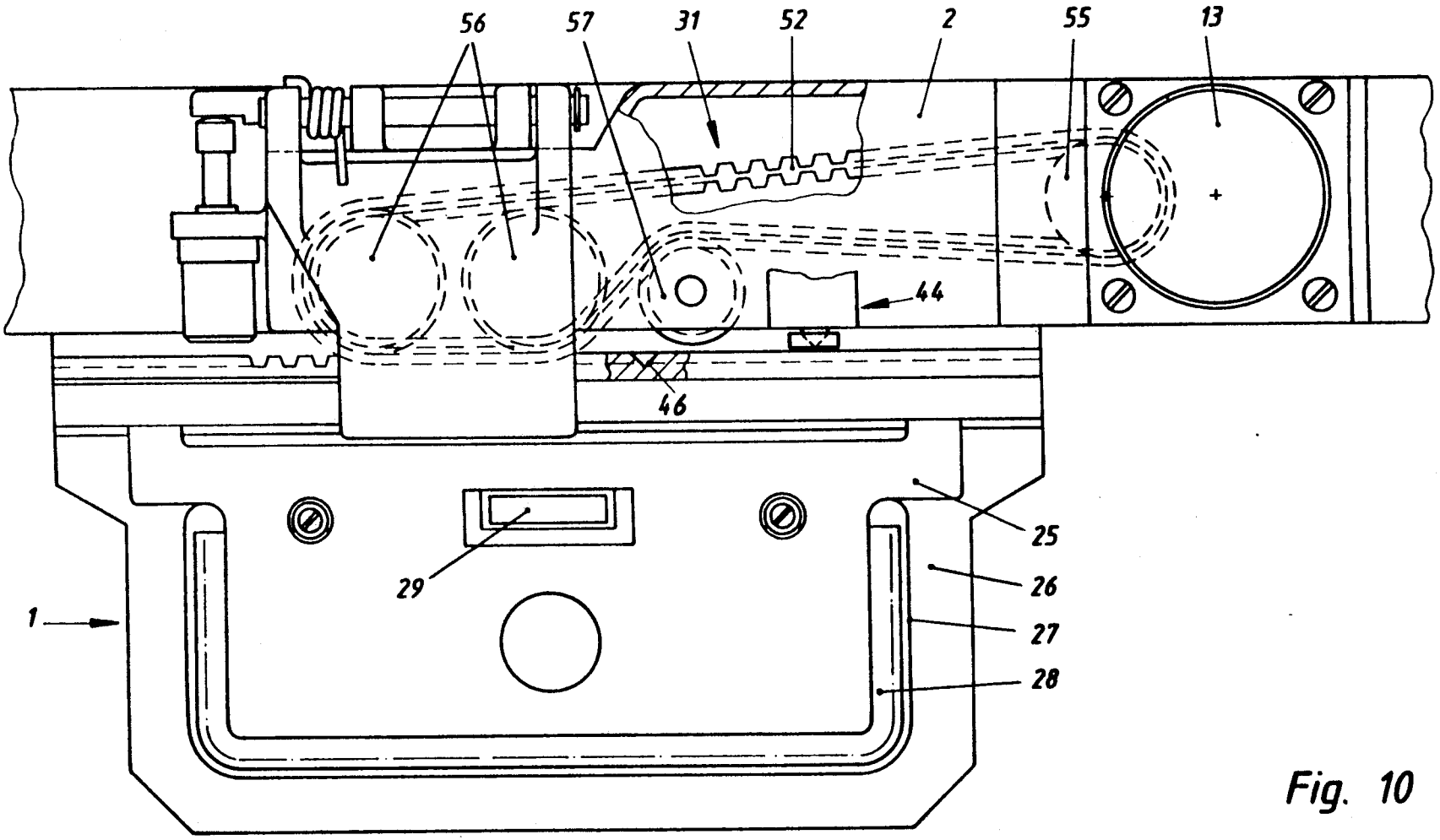
FIG. 10 is a top view of the sewing-material holder and its drive as seen in the direction indicated by the arrow N in FIG. 9.
Figure 11:
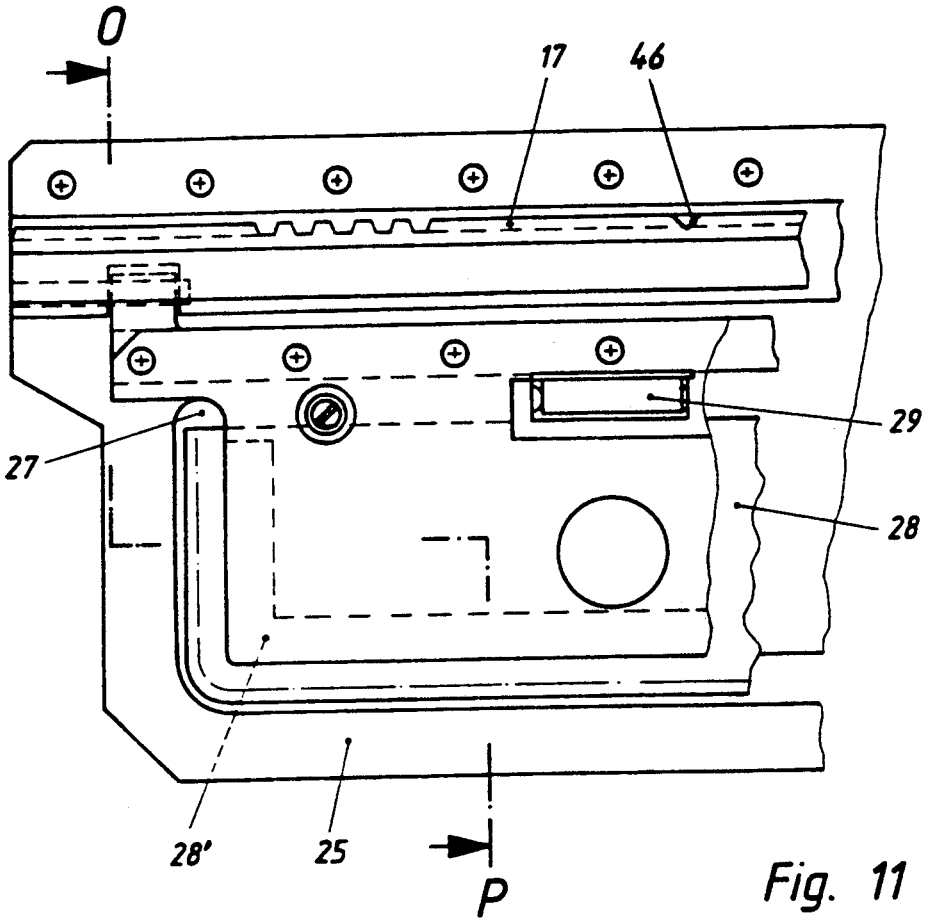
FIG. 11 is a detailed top view showing a partial region of the sewing-machine holder.

In the embodiments shown in FIGS. 6, 7, 9 and 10, the drive member 31 is represented by a second toothed belt 52. In the embodiment shown in FIG. 6, the toothed belt 52 has outside toothing and, in the embodiment shown in FIGS. 7, 9 and 10, it is toothed on both sides. The advantage of this drive as compared with the rack and pinion drive 30 shown in FIGS. 1 to 5, consisting of the pinion 12 and the rack 17, is that with the toothed belt 52, a large number of teeth are in engagement with the rack 17, as a result of which less wear and quiet operation can be obtained. As can be noted from FIG. 9, the outside-toothed belt 52 is driven by the motor 13 via a step-down gearing 53, the motor 13 being fastened to the carrier 2. The toothed belt 52, as shown in FIG. 10, wraps around a toothed-belt pulley 55 provided near the motor 13, as well as two additional toothed-belt pulleys 56 and a reversing roller 57.

Figure 7:
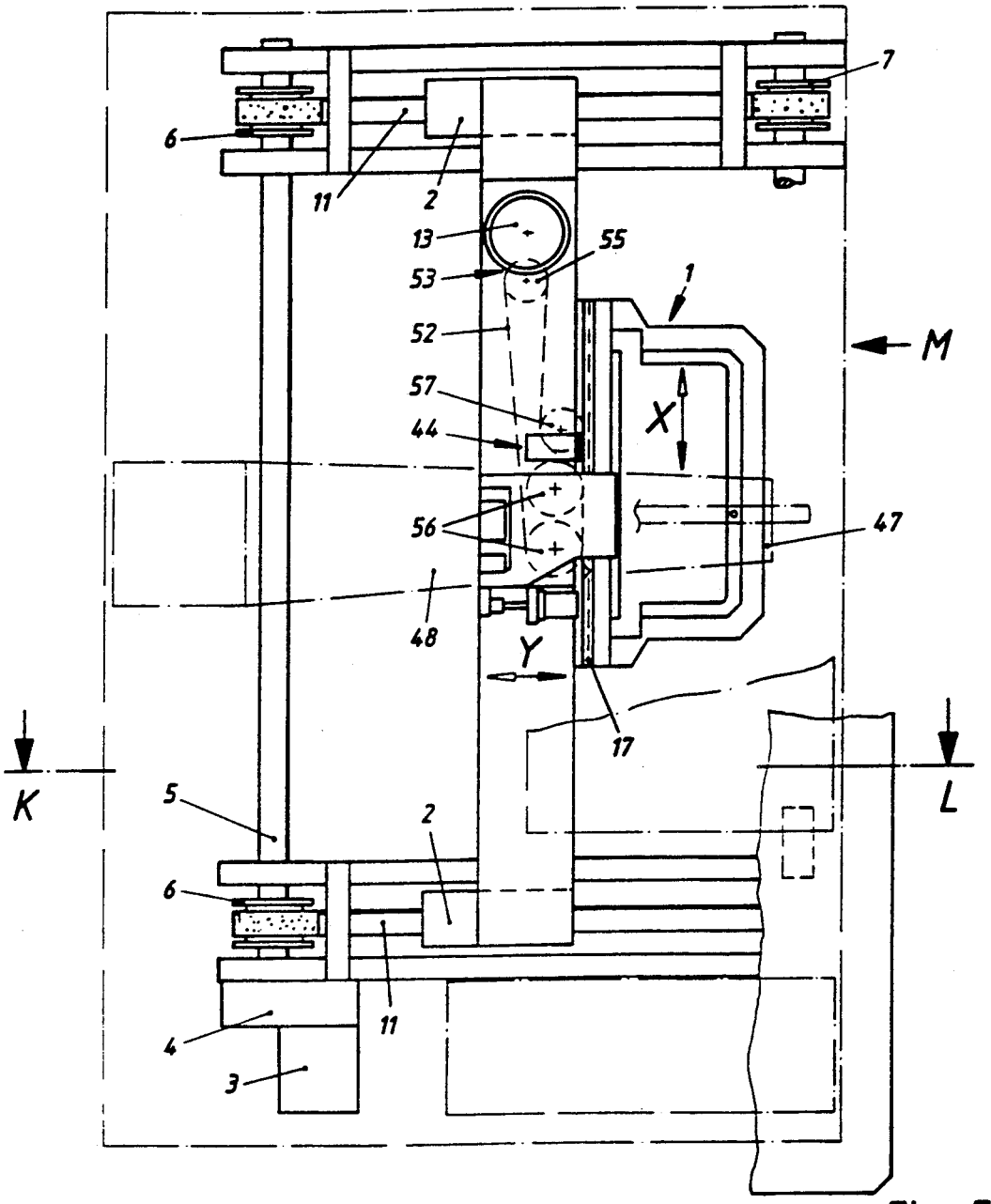
FIG. 7 is a top view of the sewing machine according to a third embodiment of the invention, showing a movable sewing-machine holder which can be driven by a toothed belt and a rack.
Figure 8:
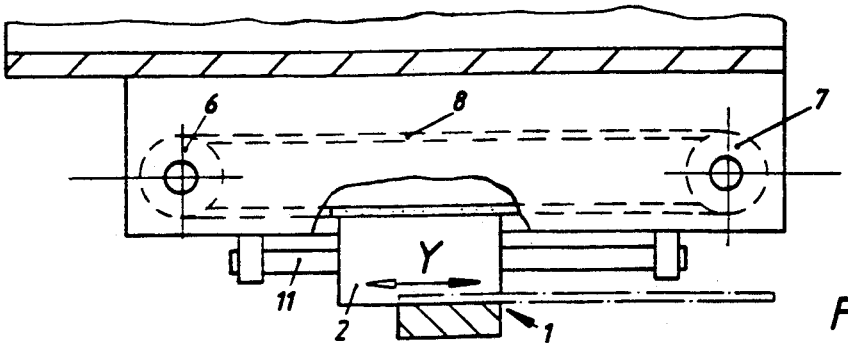
FIG. 8 is a side view of the drive for moving the carrier in the Y-direction, taken along the line K-L of FIG. 7.
Figure 9:
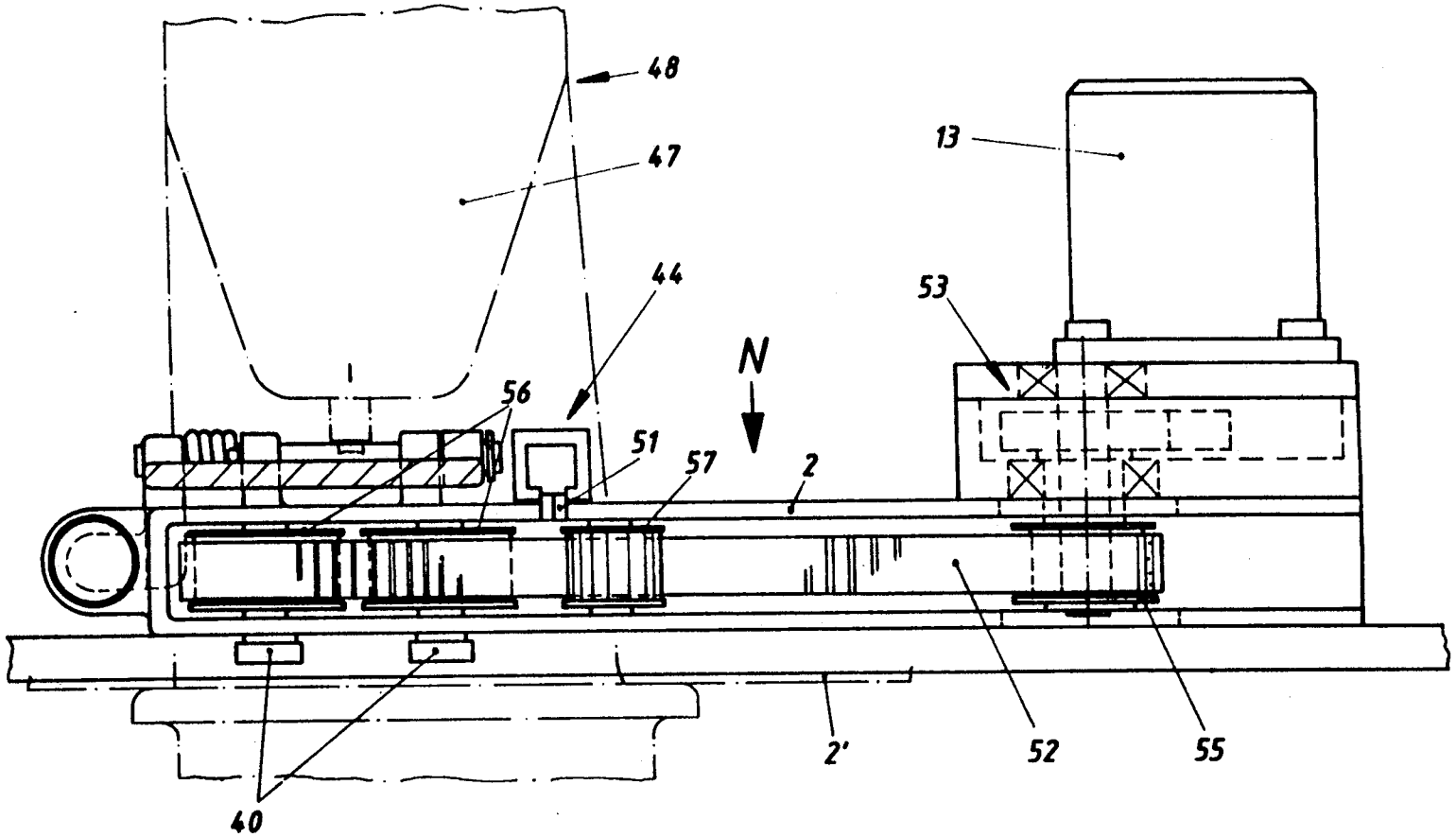
FIG. 9 is a simplified front view of the sewing machine, taken in the direction M indicated in FIG. 7.

The embodiment shown in FIG. 6, like the embodiment shown in FIG. 1, has a smaller toothed-belt pulley 14 on the stub shaft of the motor 13 and a larger toothed-belt pulley 15, around both of which the toothed belt 16 is wrapped Firmly attached to the toothed belt pulley 15 there is a further toothed-belt pulley 58 which drives the toothed belt 52. The latter wraps around two reversing rollers 59 rotatably mounted on the carrier 2. As an abutment to take up the pressure exerted by roller 37 via the rack 17 on the toothed belt 52 there is provided a strap 60 standing on edge, fastened to the carrier 2 (see FIG. 6). The sewing-material holder 1 shown in FIGS. 7 and 8 is driven, as in the embodiment shown in FIG. 1, via two pairs of toothed-belt pulleys 6 and 7, two toothed belts 8 and two driver connections 9, by the motor 3 fastened to the frame, via the step-down gearing 4.

Figure 13:
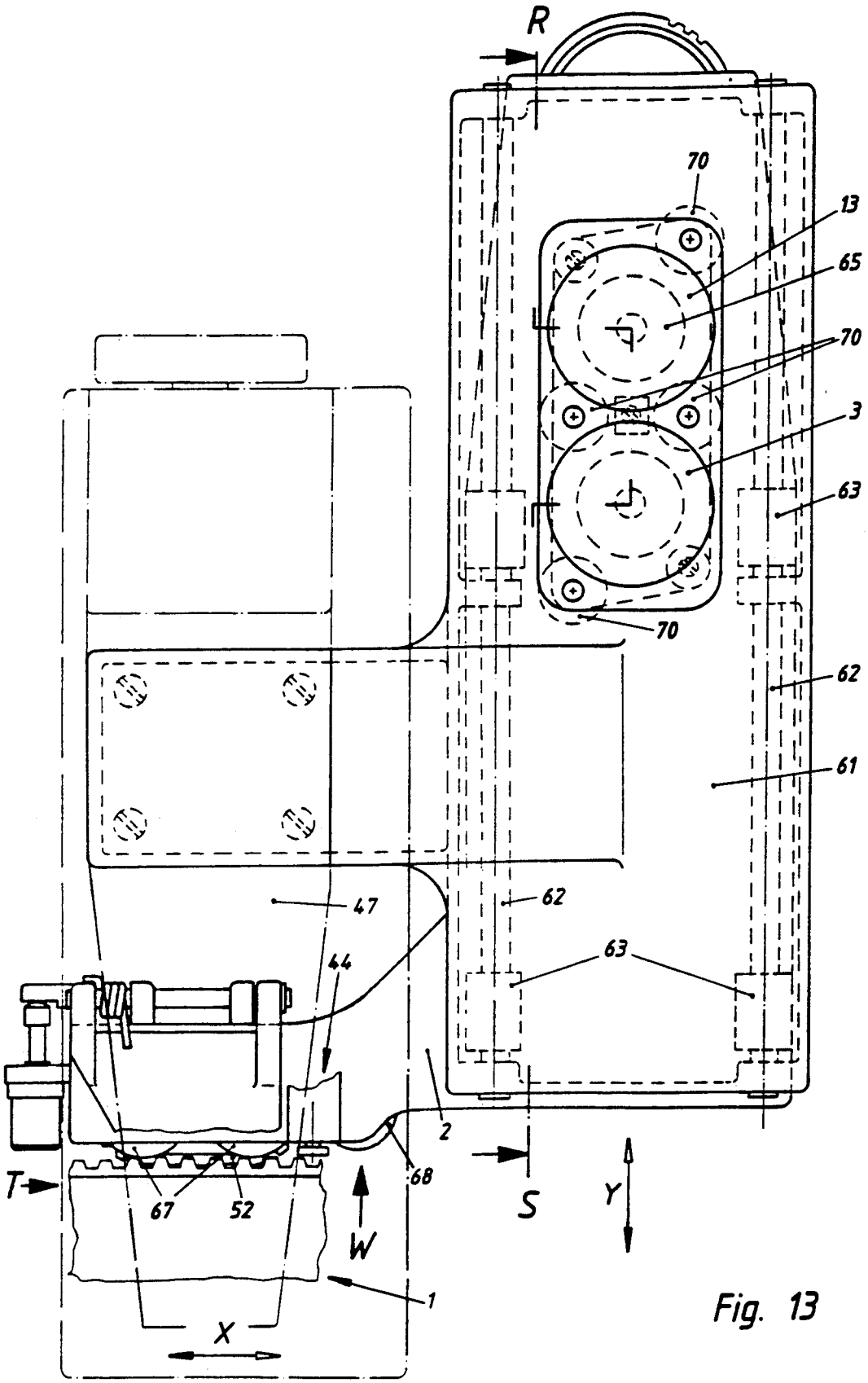
FIG. 13 is a top view of a sewing machine according to a fourth embodiment of the invention, wherein the sewing-material holder is movable via a toothed belt by a carrier which is movably secured to the arm head of the sewing machine.
Figure 14:
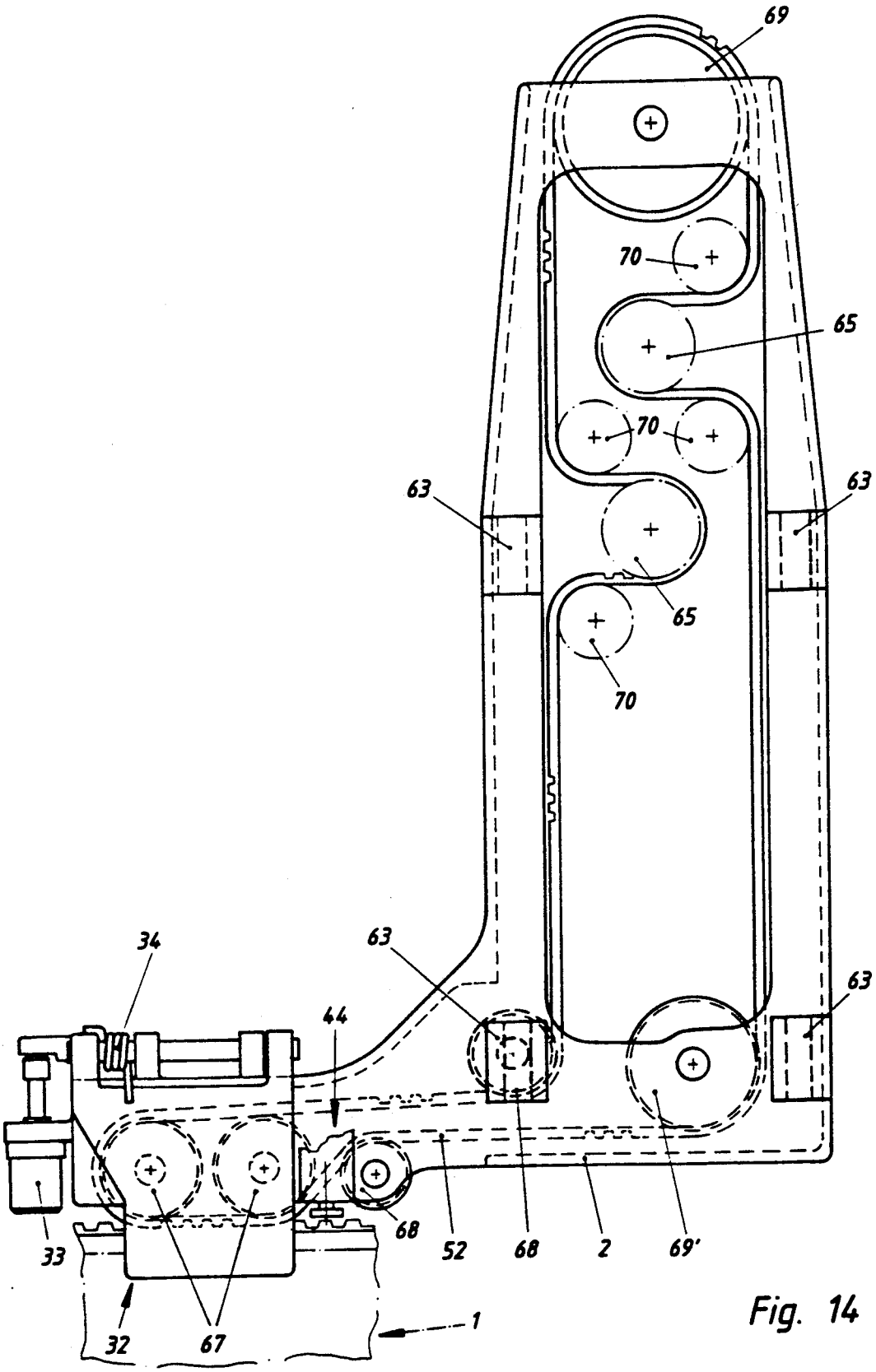
FIG. 14 is a top view of the carrier of FIG. 13 showing the course of the toothed belt.
Figure 15:
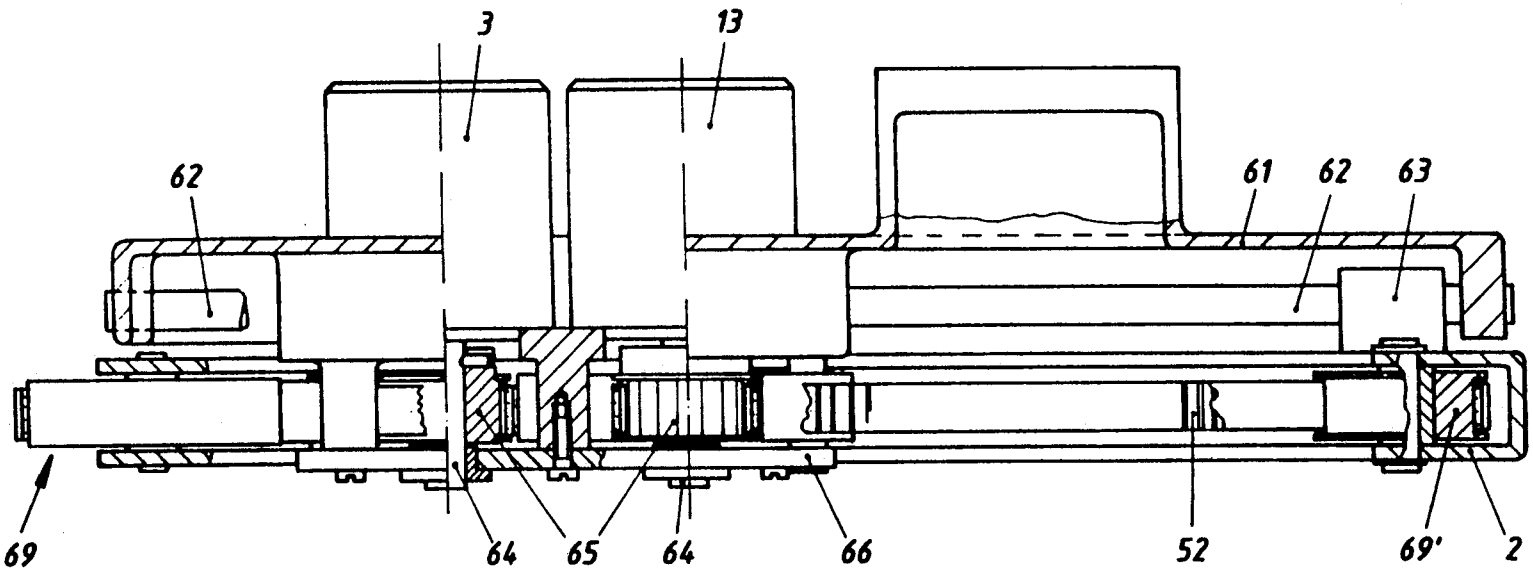
FIG. 15 is a side view of the carrier along the section line R-S of FIG. 13.
Figure 19:
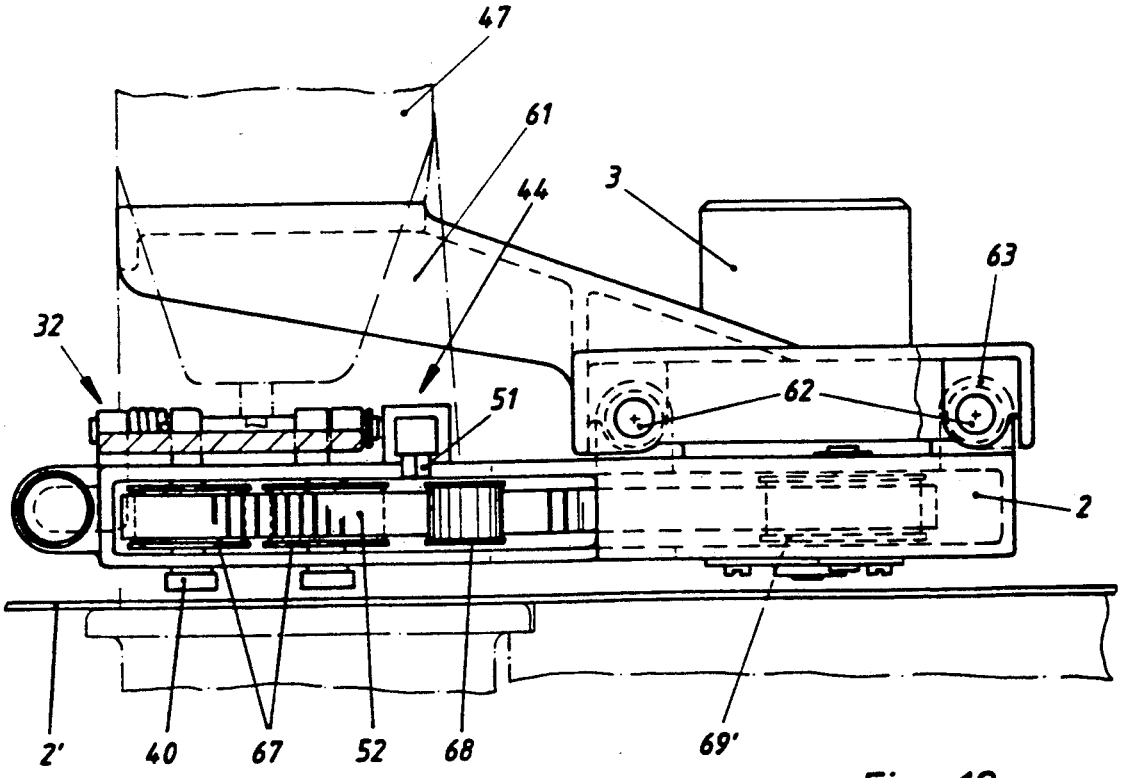
FIG. 19 is a front view of the sewing machine and the carrier arranged thereon, as seen in the direction indicated by the arrow W in FIG. 13.

In the embodiment shown in FIGS. 13 to 15 and FIGS. 17 to 19, the drive member 31 is also represented by the toothed belt 52 which is toothed on the outside and forms the toothed drive 30 with the rack 17, as in the embodiment of FIG. 6. It also has the following special feature In contradistinction to all embodiments previously described, the motor 13 is arranged fixed to the frame in the same way as the motor 3. This fact can be noted from FIGS. 13, 15 and 19. By placing both motors 3 and 13 firmly on the frame, the weight of the carrier 2 is considerably reduced. A motor support frame 61, to which the motors 3 and 13—as shown in FIG. 15—are firmly attached, is fastened on the arm head 47, as shown in FIGS. 13 and 19. Within the motor support frame 61 there are two slide rods 62. The latter are received by four bearing blocks 63 which are provided on the carrier 2, as shown in FIGS. 15 and 19. Separate toothed-belt pulleys 65 are connected to the stub shafts 64 of the motors 3 and 13, the stub shafts 64 being mounted in known manner in a bearing plate 66, as shown in FIG. 15. The plate is fastened on the bottom of the motor support frame 61 (FIG. 15). In the embodiment mentioned above, the following parts are mounted for rotation in the carrier 2 in accordance with FIGS. 14, 15, 18 and 19 via two guide rollers 67, two small reversing rollers 68, two large reversing rollers 69, 69', and four deflection rollers 70. The rollers 67 to 70 are wrapped, as shown in FIG. 14, by the outside-toothed belt 52, at least the rollers 67 to 69 and 69' preferably having a groove for the form-locked guidance of the toothed belt 15 (see the reversing roller 69' in FIG. 15).

The compressed air necessary for actuating the compressed air-cylinders 33 and 49 is obtained via hoses and pneumatic parts not shown here, such as solenoid valves, throttles or the like, from an external source of compressed air, which is also not shown here. The start and duration of the corresponding actuation is controlled by a control 71 which also controls the motors 3 and 13, which are preferably stepping motors.

The manner of operation of the sewing-material holder and drive described above will now be described.

Initially, a seam is completed along a desired course in the sewing part 28, which for this purpose has been clamped in the sewing-material holder 1 and moved corresponding to the desired course of the seam in the X- and Y-directions. Then the compressed-air cylinder 33 is vented, allowing the guide block 32 to assume its upper position, shown in FIG. 16. In this way, the form-locked connection of the carrier 2 via the guide block 32 to the sewing-material holder 1 is eliminated.

It is common to all the embodiments described above that the toothed drive 30 responsible for the movement of the sewing-material holder 1 in the X-direction includes the drive member 31 mounted on the carrier 2 and the rack 17 connected to the sewing-material holder 1. Therefore, in all the embodiments, the sewing-material holder 1 can be removed from the carrier 2 after the guide block 32 has been swung into its upper position (FIG. 16).

At the same time the control 71 causes motor 13 or both motors 3 and 13 to turn such that, depending on the embodiment described above, either the pinion 12 (FIGS. 1 to 5) or the toothed belt pulley 58 (FIG. 6) or the toothed belt pulleys 56 (FIGS. 10 and 17) or the toothed belt pulleys 65 (FIGS. 14 and 15) carry out a turning movement, of less than 360°. By this turning movement, which is referred to as the "nulling process", the drive member 31 is placed in a predetermined starting position, for beginning the next sewing process.

Simultaneously with carrying out the above-described "nulling process", the compressed air cylinder 49 is acted on by compressed air so that its piston rod 50 and thus the pawl 51 move into their forward position. When mounting the following sewing-material holder 1 which is loaded with an unsewn sewing part 28, it is only necessary for the pawl 51 to engage into the recess 46 of the sewing-material holder 1. Thus a well-defined positional association is arranged between the sewing-material holder 1 and the carrier 2, as well as the sewing needle 45. After the sewing-material holder 1 is mounted, the compressed-air cylinder 49 is returned to its inactive position, as a result of which the pawl 51 is retracted (FIG. 5).

At the same time, the compressed-air cylinder 33 is actuated, causing the guide block 32 to be swung into its low position (FIG. 16), whereby the sewing-material holder 1 is connected in form-locked manner with the carrier 2. The motors 3 and 13 are controlled by the control 71 for carrying out the next sewing process, causing the sewing-material holder 1 to carry out the desired movements in the X- and Y-directions. In this connection it is self-evident that, during these movements, the point of the sewing needle 45 must be above the clamping plate 25.

In the embodiment shown in FIGS. 13 to 15 and FIGS. 17 to 19, the motors 3 and 13 are fixed to the frame and are controlled as follows. If the toothed-belt pulleys 65 shown in FIG. 14 turn synchronously in the same direction, then the toothed belt 52 is moved continuously, as a result of which the sewing-material holder 1 driven by it can be moved in the X-direction. On the other hand, if the toothed-belt pulleys move synchronously in opposite directions, they then drive the toothed belt 52 so that the center distance between the reversing roller 69' and the toothed-belt pulley 65 closest to it changes continuously and the carrier 2 is pushed via the bearing blocks 63 along the slide rods 62. As a result, the carrier 2 is movable in the Y-direction. By correspondingly controlling the motors 3 and 13, all conceivable movements of the sewing-material holder 1 can be obtained as a result of superimposing such X- and Y-directional movements.

Although the present invention has been described in relation to particular embodiments thereof, the spirit and scope of the claimed invention is not so limited, but rather includes many other variations, modifications and other uses that will become apparent to those skilled in the art.

What is claimed is:

1. A sewing machine having a sewing-material workpiece holder which is movable in first and second mutually transverse directions relative to a sewing needle of the sewing machine, for obtaining a seam extending along a desired path, comprising:

a frame;

a carrier mounted on said frame; first drive means including a first motor for moving said carrier in said first direction;

said workpiece holder being supported on said carrier; the carrier having second drive means thereon connected to a second motor for driving said holder in said second direction; said holder having a rack thereon extending in said second direction; said second drive means including a toothed drive member on said carrier which drivingly engages said rack on said holder; and locking means for locking said workpiece holder to said carrier and permitting said workpiece holder to be rapidly mounted on and released from said carrier.

2. A sewing machine as in claim 1, further comprising alignment means for locating said holder at a predetermined position with respect to the carrier.

3. A sewing machine as in claim 2, wherein said alignment means comprises a latch mounted on the carrier and a recess formed on the workpiece holder, and means for moving said latch toward said holder for engaging said recess.

4. A sewing machine having a sewing-material workpiece holder which is movable in first and second mutually transverse directions relative to a sewing needle of the sewing machine, for obtaining a seam extending along a desired path, comprising:

a frame;

a carrier mounted on said frame; first drive means including a first motor for moving said carrier in said first direction; and said workpiece holder being supported on said carrier; the carrier having second drive means thereon connected to a second motor for driving said holder in said second direction; said holder having a rack thereon extending in said second direction; said second drive means including a toothed drive member on said carrier which drivingly engages said rack on said holder;

further comprising alignment means for locating said holder at a predetermined position with respect to the carrier;

wherein said alignment means comprises a latch mounted on the carrier and a recess formed on the workpiece holder, and means for moving said latch toward said holder for engaging said recess;

wherein said means for moving said latch toward said holder comprises a pressure-actuatable cylinder mounted on said carrier.

5. A sewing machine as in claim 1, wherein said toothed drive member is a pinion on said carrier which is driven by said second motor via a toothed belt.

6. A sewing machine as in claim 1, wherein said toothed drive member is an endless toothed belt on said carrier which is driven by said second motor.

7. A sewing machine as in claim 6, wherein said second motor is mounted on said carrier.

8. A sewing machine as in claim 6, wherein said first and second motors are both mounted on said frame and drivingly engage opposite respective sides of said endless toothed belt; such that rotation of said motors in the same direction drives said carrier in said second direction, and rotation of said motors in opposite directions drives said carrier in said first direction.

9. A sewing machine as in claim 1, wherein said locking means is for locking said toothed drive member to said rack, wherein said locking means comprises a clamp mounted on said carrier which is movable into a locking position in which it engages said workpiece holder, said clamp having at least one horizontal roller which engages said workpiece holder in said locking position to lock said rack to said toothed drive member on said carrier.

10. A sewing machine as in claim 9, wherein said clamp further comprises at least two vertical rollers which engage said workpiece holder when in said locking position.

11. A sewing machine as in claim 10, wherein said clamp further comprises at least one additional horizontal roller which engages said workpiece holder near said rack.

12. A sewing machine as in claim 9, wherein said clamp is movable into said locking position by a pressure-actuatable cylinder mounted on said carrier.

* * * * *